United States Patent [19]

Dietrich et al.

[11] 4,255,953

[45] Mar. 17, 1981

[54] COMBINATION SPRING/DEAD BOLT LOCK

[75] Inventors: Hagen Dietrich, Delta; William J. Fane, North Vancouver, both of Canada

[73] Assignee: Norris Industries, Inc., Long Beach, Calif.

[21] Appl. No.: 35,208

[22] Filed: May 2, 1979

[51] Int. Cl.[3] ..... E05B 55/00

[52] U.S. Cl. ..... 70/107; 70/143; 70/482; 292/169.15; 292/DIG. 27

[58] Field of Search ..... 70/107, 472, 108-111, 70/129, 134, 143; 292/140, 169.15, 169.17, DIG. 27

[56] References Cited

U.S. PATENT DOCUMENTS

| | | | |
|---|---|---|---|
| 2,664,306 | 12/1953 | Cerf, Jr. | 292/169.17 X |
| 3,751,085 | 8/1973 | Sanders et al. | 292/169.15 X |
| 3,790,196 | 2/1974 | Sanders et al. | 292/140 |
| 3,912,309 | 10/1975 | Fischer et al. | 70/143 X |

*Primary Examiner*—William E. Lyddane

[57] ABSTRACT

One part of a key-in-knob lock set functions in a normal manner such that when the lock set is unlocked, either the outside or inside knob can be manipulated to open the door by withdrawing the latch bolt from a normal spring latch extended position. When, instead, the lock set is locked, the latch bolt is extended an exceptionally long distance into the frame to a dead bolt position. Extension and retraction of the latch bolt to and from dead bolt position is accomplished by manipulation of a main cam through the agency of a key in the outside knob or a turn button on the inside knob.

For withdrawing the latch bolt from the normal spring latch extended position an escutcheon housing for the outside knob or a corresponding escutcheon housing for the inside knob serves, by moving transversely of the axis of rotation of the knob, to rotate a radially extending finger on the spindle which, acting through the main cam, withdraws the latch bolt.

By rotation of the key in the outside knob, or the turn button on the inside knob, the spindle is rotated a greater amount, far enough to have the main cam extend the latch bolt an additional distance to the dead bolt position. In that deadbolt position the finger for the hub cam of the outside knob is moved out of the path of movement of the respective drive housing so that rotation of the outside knob has no effect on the latch bolt. The finger for the hub cam of the inside knob remains, however, in the path of movement of the corresponding drive housing so that rotation of the inside knob does in fact withdraw the latch bolt from the dead bolt position.

18 Claims, 19 Drawing Figures

Fig. 5.
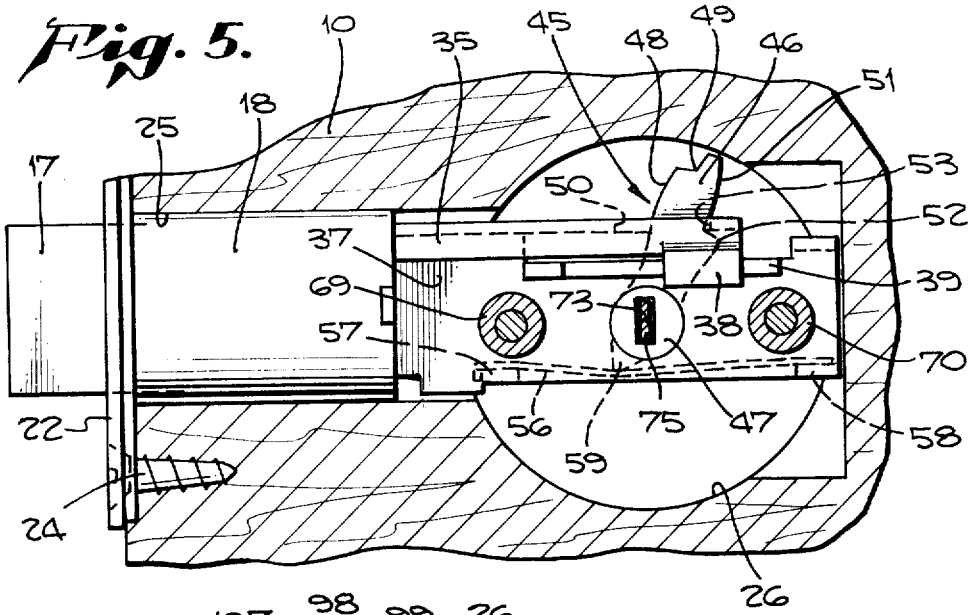
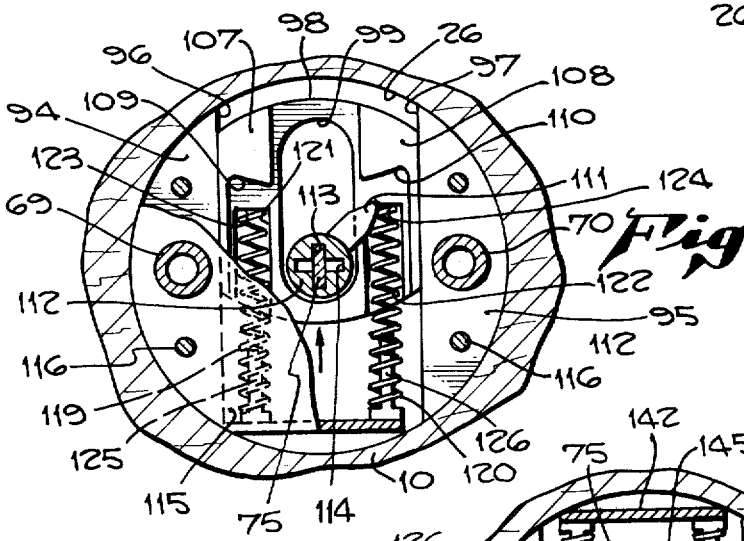
Fig. 6.
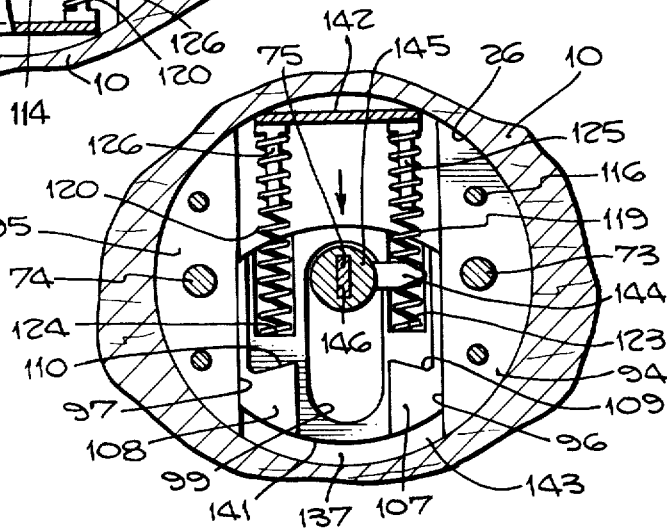
Fig. 7.

Fig. 11.
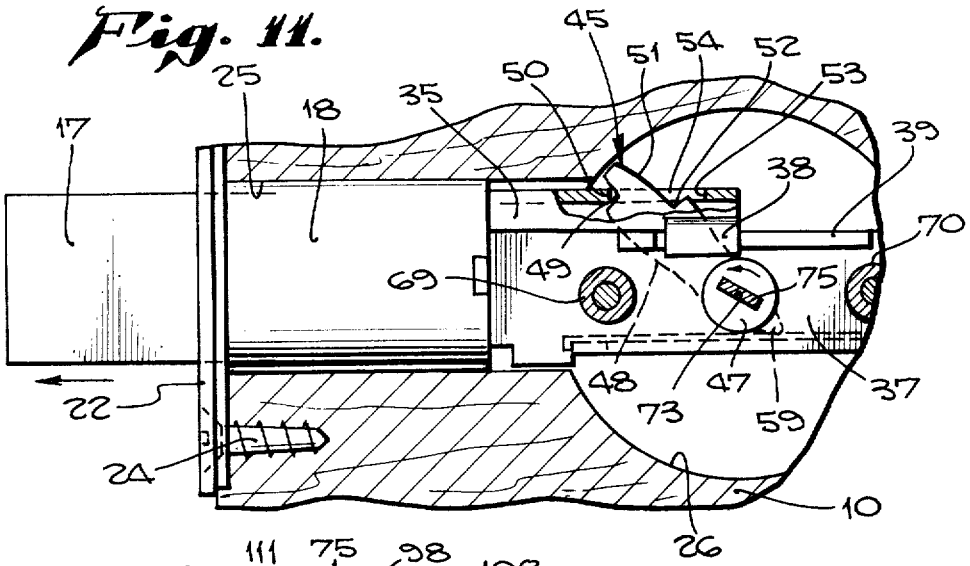
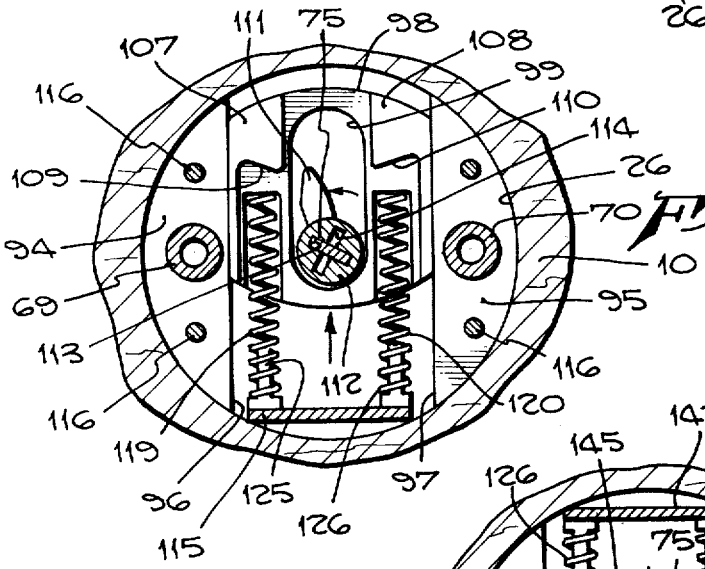
Fig. 12.
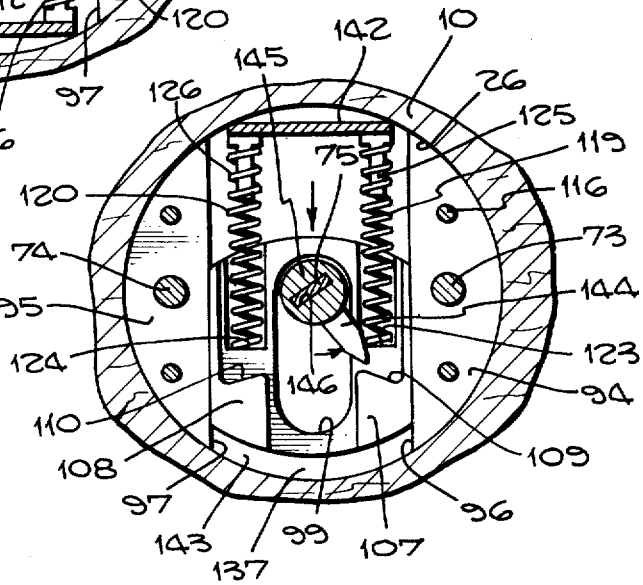
Fig. 13.

COMBINATION SPRING/DEAD BOLT LOCK

With the progressive increasing incidents of unlawful entry into locked premises there have at the same time been appreciable increase in employment of dead locks built into what are commonly identified as key-in-knob locks. Such key-in-knob locks offer relatively little security because, whether or not the dead lock feature is included, there is no more than about one-half inch bolt projection. To compound the deficiency when a one-eighth inch minimum gap between the door jam is maintained there remains no more than about three-eighths inches of maximum positive engagement of the latch bolt with the strike plate. When an installation of such character is the object of unlawful entry the door jam can be spread slightly further away from the door using any one of a number of conventional prys which is sufficient to have the latch bolt clear the strike and permit the door to be swung open. The three-eighths inch or less engagement is so little that on some occasions it may be possible to pry the latch bolt back by merely inserting a credit card into the clearance until it engages the latch bolt.

In appreciation of these limitations there has been a considerable increase in the use of auxiliary dead bolts. Although such auxiliary dead bolts add appreciably to the security of an installation they are an extra piece of hardware, require an additional installation hole in the door and the door jam, and frequently require an additional key, where they cannot be keyed to match the key-in-knob lock set. Such installations further complicate the inside panic prospect which needs to be guarded against and which is apt to be more prevalent as the security expedient is increased.

It is therefore among the objects of the invention to provide a new and improved spring-type latch which is modified so that it can also serve as a dead bolt lock.

Another object of the invention is to provide a new and improved spring-type latch of such construction that the same latch bolt serving as a spring-type latch can serve as a dead bolt lock when greater security is desired.

Still another object of the invention is to provide a new and improved spring-type latch bolt which extends no more than the conventional distance into the door jam while the lock set is serving as a passage set but which by manipulation of either a key on the outside or a thumb turn on the inside can be extended an additional distance into the door jam to serve as a dead bolt lock with its accompanying added security.

Still another object of the invention is to provide in one lock set a latch bolt serving either as a spring latch or a dead bolt lock, and which, at the same time, is of such construction that although extended to dead lock position by a key on the outside the latch bolt can be readily and immediately withdrawn to unlocked position on the inside by merely turning the knob.

Still further among the objects of the invention is to provide a new and improved door lock of the type wherein the latch bolt serves simultaneously either as a spring latch or a dead bolt lock in an arrangement such that the latch bolt is normally extended to the spring latch position but which can be further extended by key action in the outside knob or by comparable activity on the inside which may be either a turn button if desired or other means, whereby to extend the latch bolt to dead bolt position, the latch bolt then being capable of being unlocked either by key actuation on the outside or by merely knob action on the inside. The foregoing objects further include that of providing in the mechanism for extending the latch bolt to dead bolt position one wherein there is abundance of positive engagement of the latch bolt with the strike in the dead bolt position, and being further such that the latch bolt cannot be pryed out of position.

With these and other objects in view, the invention consists of the construction, arrangement and combination of the various parts of the device serving as an example only of one or more embodiments of the invention, whereby the objects contemplated are attained, as hereinafter disclosed in the specification and drawings, and pointed out in the appended claims.

FIG. 5 is a side elevational view of the latch bolt subassembly, with the latch bolt in spring latch position on the line 5—5 of FIG. 1.

FIG. 6 is a cross-sectional view on the line 6—6 of FIG. 2.

FIG. 7 is a cross-sectional view on the line 7—7 of FIG. 2.

FIG. 11 is a side elevational view of the latch bolt subassembly similar to FIG. 5 but with the latch bolt in dead bolt position.

FIG. 12 is a cross-sectional view similar to FIG. 6 with parts in locked position.

FIG. 13 is a cross-sectional view similar to FIG. 7 with parts in locked position.

Figure 1:
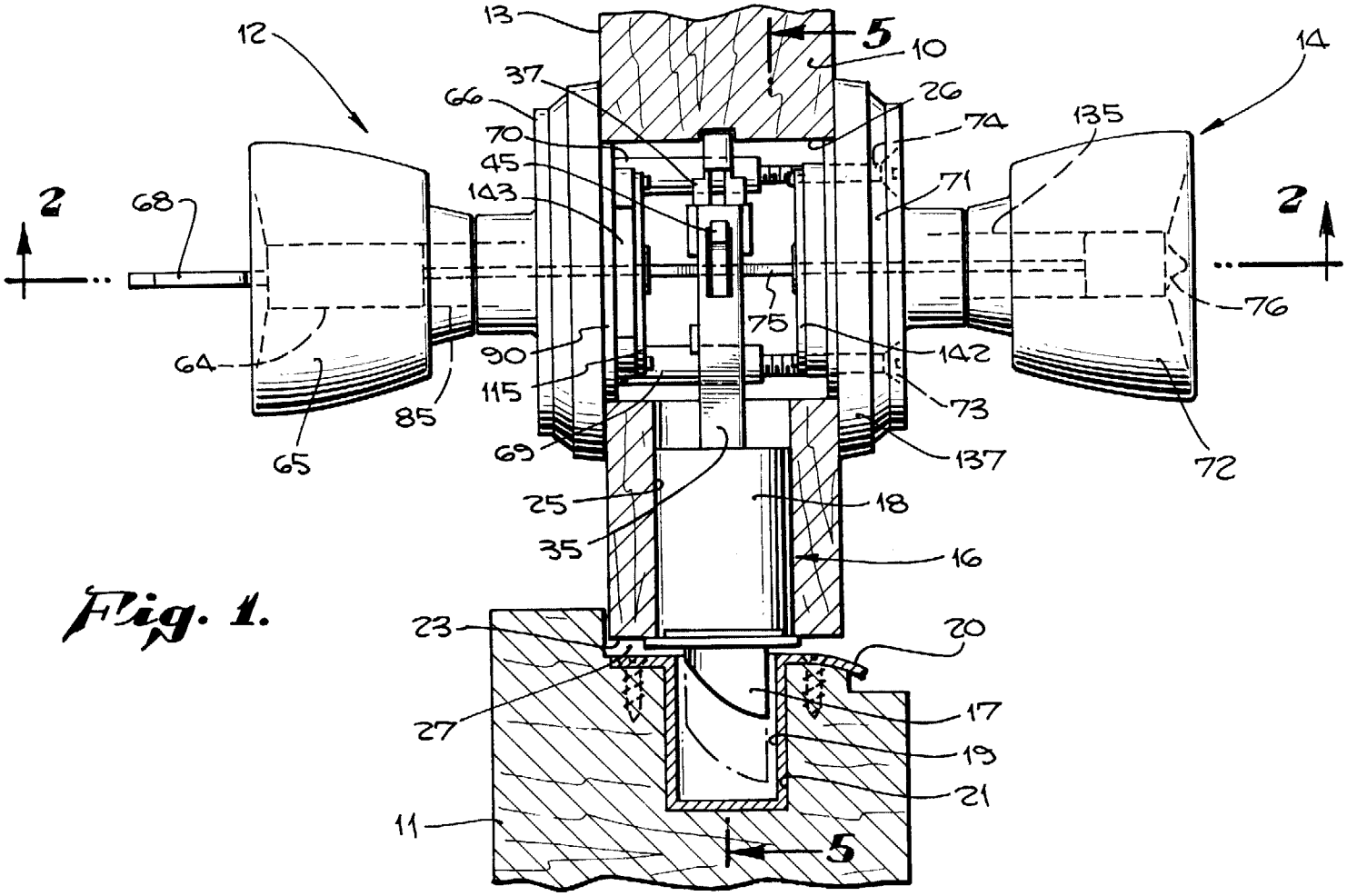
FIG. 1 is a transverse fragmentary sectional view of a door and door jamb showing a complete lock set mounted in operating position.

An embodiment of the invention chosen for the purpose of illustration features a lock set of the type used on outside doors of houses, apartments and comparable structures.

The combination of spring/dead bolt lock is shown mounted on a fragment of door 10 which is adapted to swing relative to a door jam 11. The device consists in the main of an outer trim 12 applied to an outside surface 13 of the door 10, an inner trim 14 applied to the inside surface 15 of the door and a latch bolt subassembly 16. The latch bolt subassembly includes a latch bolt 17 reciprocatably mounted in a face and case assembly 18 so that it can project through a hole 19 in a strike plate 20, the strike plate 20 being attached to the door jam 11 over a latch bolt recess 21. A face plate 22 is attached to a edge face 23 of the door 10 by means of appropriate screws 24. An edge hole 25 extending inwardly from the edge face 23 accommodates the face and case assembly 18 together with a latch bolt subassembly operating with it. A transverse hole 26 intersects the edge hole and accommodates the sundry operating parts of the combination spring/dead bolt lock.

As shown in the drawings the door 10 has been mounted for swinging between open and closed position relative to the door jam 11 in an arrangement such that there is a gap or clearance 27 of a conventional distance through which the latch bolt 17 must extend before engaging the strike plate 20.

The latch bolt subassembly 16 is of substantially conventional construction and operation such as has been disclosed in U.S. Pat. Nos. 3,751,085 and 3,790,196. More particularly there is provided in the latch bolt subassembly a bolt extension 35 attached to the latch bolt 17 by means of a roll pin 36. The bolt extension 35 is slidably accommodated in a case extension 37 wherein shoes 38 on opposite sides of the bolt extension are guided by tracks 39 on the case extension. A compression spring 42 acting between the bolt extension 35 and a shoulder 43 of the case extension, serving as a spring keeper, serves normally to urge the latch bolt and bolt extension outwardly to extended position.

Assembled in the latch bolt subassembly is a main cam member 45 consisting of a latch cam 46 extending radially outwardly from a hub 47 about which the latch cam is adapted to rotate. On a forward face 48 of the latch cam is a detent notch 49 which in one position, FIG. 11, of the latch cam is adapted to engage a cam engaging shoulder 50 extending transversely of the latch bolt extension 35. On a rearward face 51 of the latch cam is another detent notch 52 adapted to engage another transversely extending cam engaging shoulder 53 of the bolt extension 35. An opening 54 intermediate the cam engaging shoulders 50 and 53 accommodates the latch cam.

Figure 8:
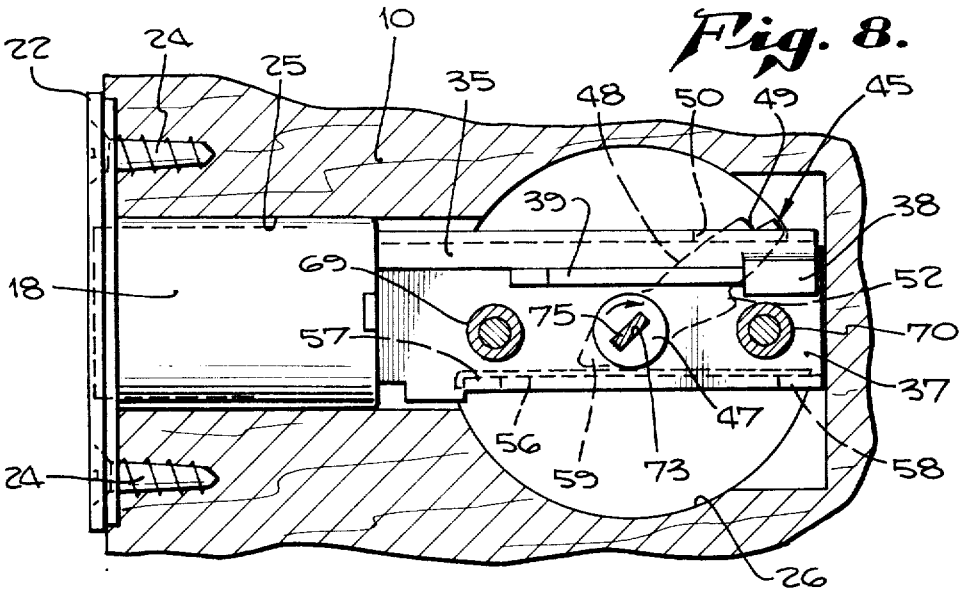
FIG. 8 is a side elevational view of the latch bolt assembly similar to FIG. 5 but in a withdrawn position.
Figure 9:
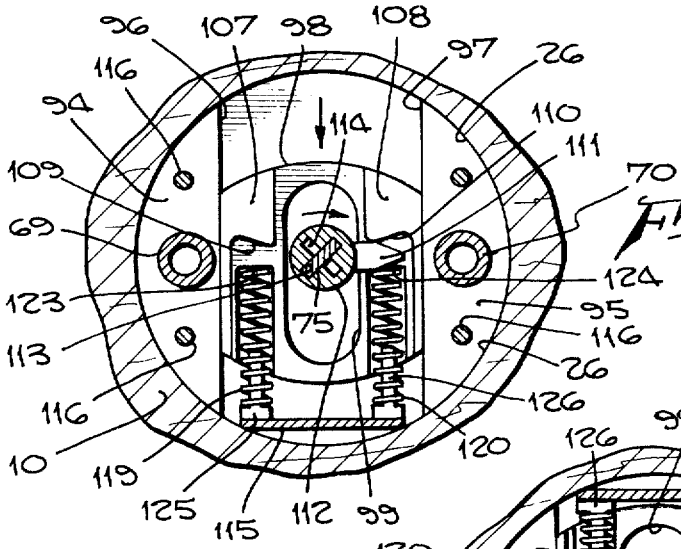
FIG. 9 is a cross-sectional view similar to FIG. 6 with parts in position for latch bolt retracted.

Flat springs 55 and 56 which span the distance, FIGS. 5 & 8, between appropriate spring keepers 57 and 58 on the case extension 37 are positioned to engage a projection 59 from the hub 47 so as to releasably hold the latch cam in over center position when the latch bolt subassembly is extended or withdrawn.

Forming part of what has previously been referred to as the outer trim 12 is an outside knob 65 rotatably mounted on an outside rose 66. The knob houses a substantially conventional key actuated mechanism 64, adapted to be manipulated by a key 68. Posts 69 and 70 attached to the inside face of the rose 66 extend through the transverse hole 26 to positions adjacent an inside rose 71 for an inside knob 72 where the posts are engaged by trim attaching screws 73 and 74. The key actuated mechanism in the outside knob 65 is operably attached to a spindle or tail piece 75, the spindle or tail piece being of a length such that it extends through the door to a position of engagement with a turn button or thumb turn 76, rotatably mounted in the inside knob 72.

Figure 14:
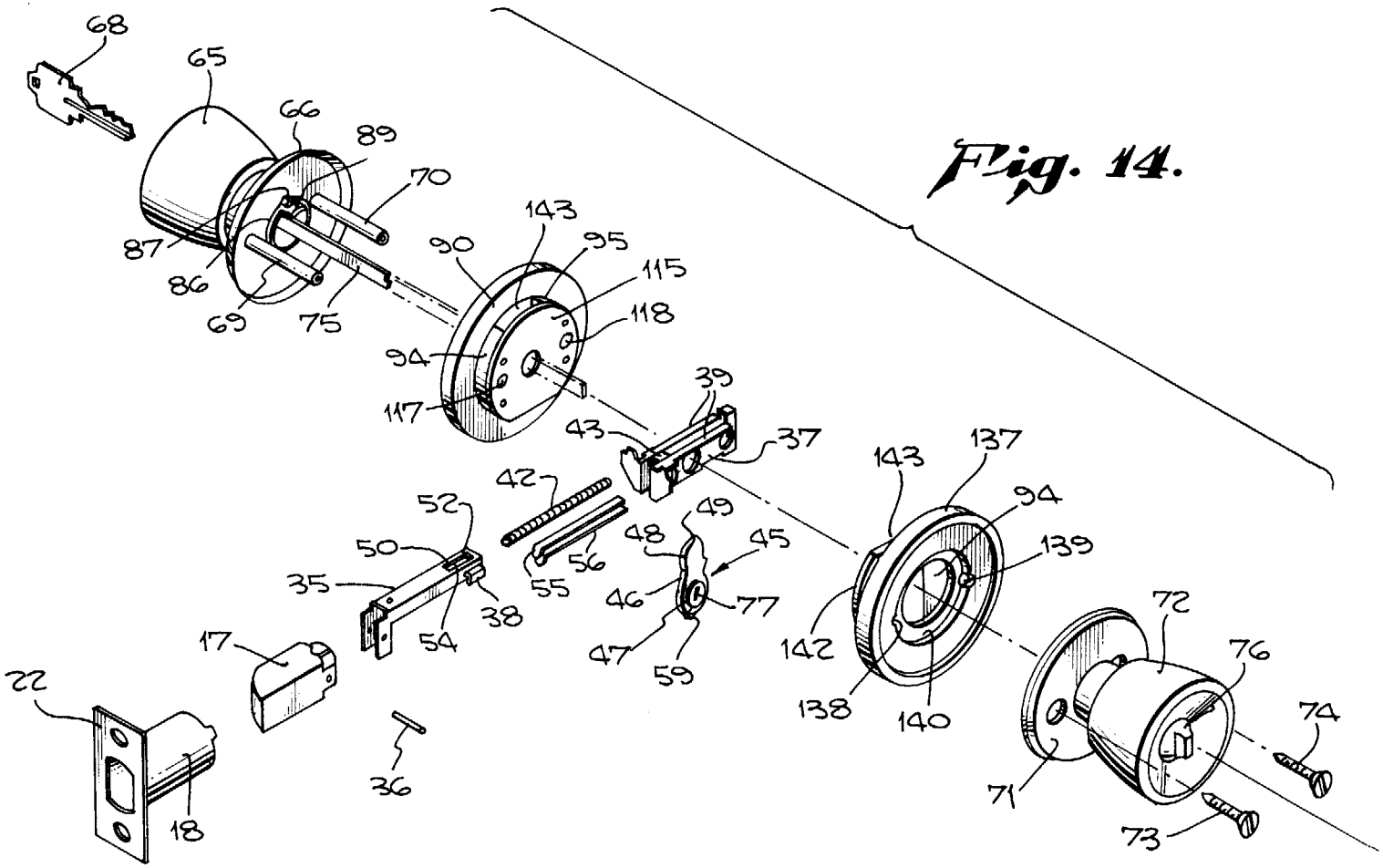
FIG. 14 is an exploded perspective view with the latch bolt subassembly disassembled.
Figure 15:
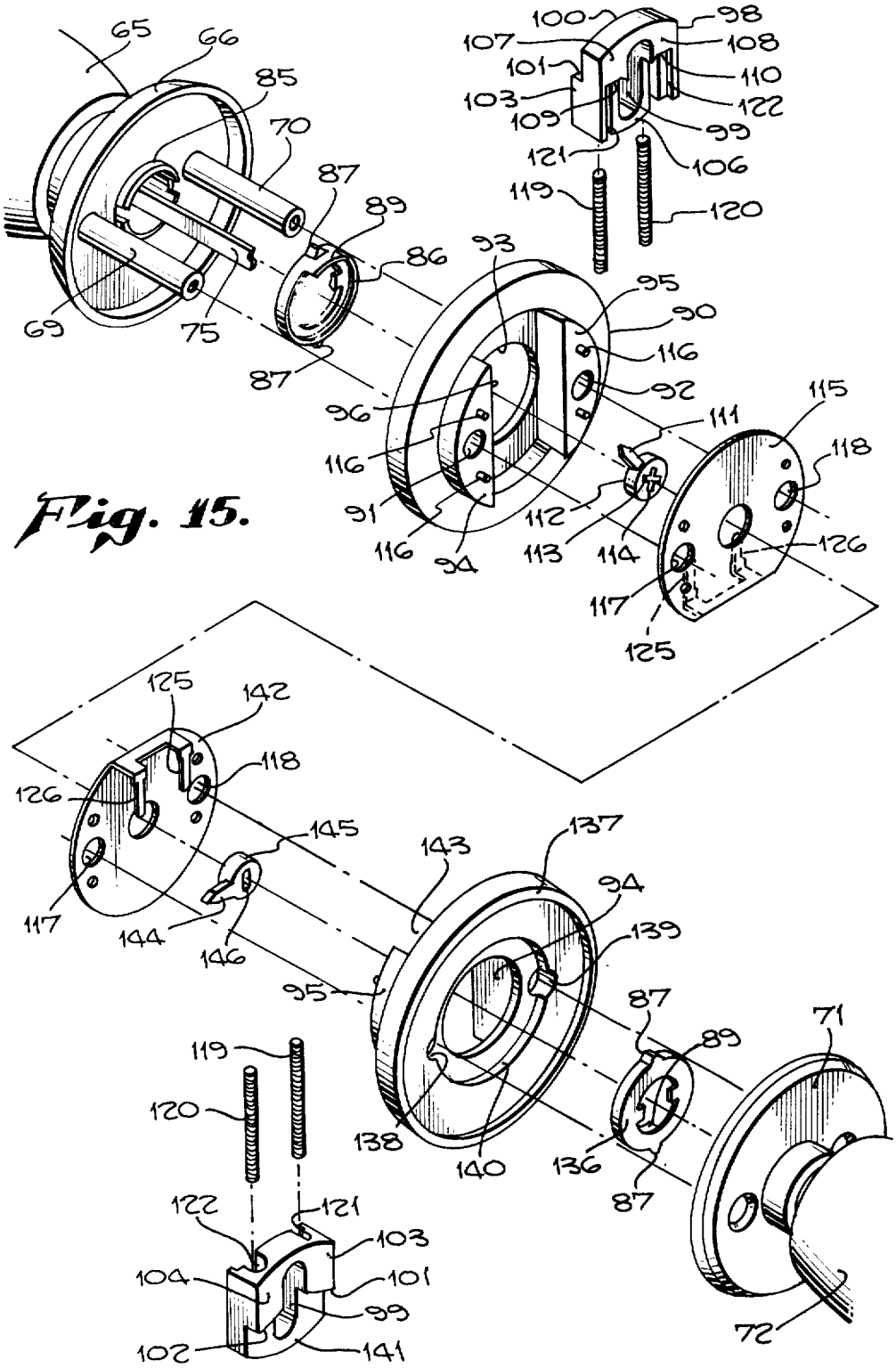
FIG. 15 is an exploded perspective view to slightly larger scale with the escutcheon housings disassembled.
Figures 16, 17, 18, 19:
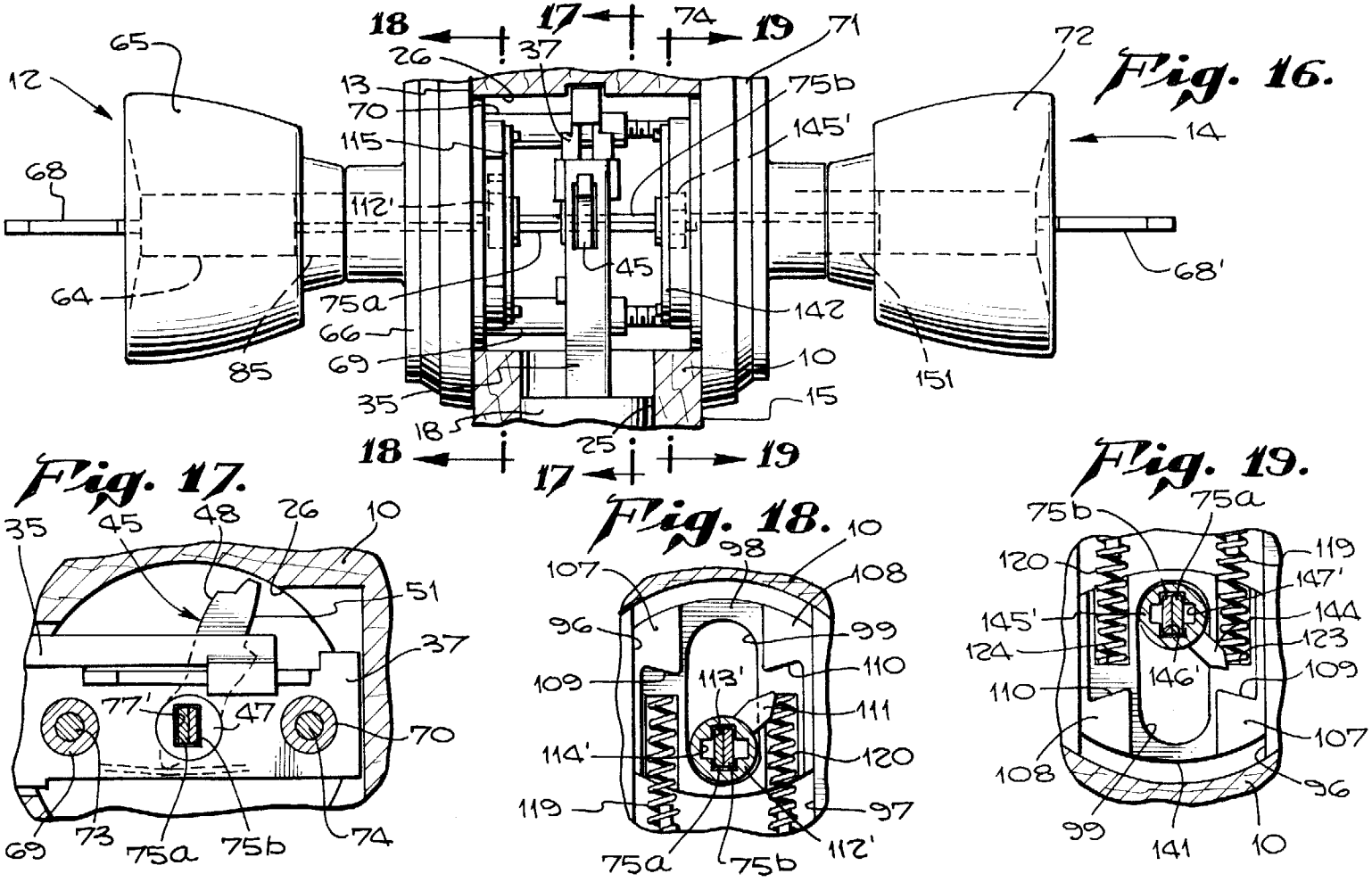
FIG. 16 is a transverse fragmentary sectional view of a door and door jamb showing a second form of a complete lock set mounted in operating position.
FIG. 17 is a fragmentary cross sectional view on the line 17—17 of FIG. 16.
FIG. 18 is a fragmentary cross sectional view on the line 18—18 of FIG. 16.
FIG. 19 is a fragmentary cross sectional view on the line 19—19 of FIG. 16.

As shown to good advantage in the exploded FIGS. 14 & 15 of the drawing the spindle 75 projects through a slot 77 the main cam member 45. As a result of this arrangement the main cam member is rotated either by action of the key 68 or by action of the turn button or thumb turn 76. Rotation in one direction projects the latch bolt 17 to dead bolt position. Rotation in the opposite direction withdraws the latch bolt to a completely withdrawn position.

For mounting the outside knob 65 in the outside rose 66 the outside knob is provided with a shank 85 extending through the rose 66 to which it is secured by action of a combination cam and retain-washer 86, the cam and retaining washer being staked to the shank 85. On the cam and retaining washer are two projections 87 spaced 180 degrees from each other and which act as a rotational stop for the knob 65 when the outer trim 12 is locked by hitting posts 69 and 70 A raised surface 89 adjacent one of the projecting stops serves to activate an outside drive housing 98.

An outside escutcheon housing 90 is provided with holes 91 and 92 for accommodation of the posts 69 and 70, the escutcheon housing 90 being such that it is capable of being drawn up snuggly against the inside face of the outside rose 66. An opening 93 accommodates the cam and retaining washer 86, FIGS. 14 and 15.

On the inner side of the outside escutcheon housing are blocks 94 and 95 provided with inwardly directed faces 96 and 97 spaced apart so as to provide a slot or guideway between them. Slidably mounted in the guideway is the outside drive housing 98 in the guise of a slide which is capable of sliding in a transverse direction within the guideway. A transversely extending aperture 99 in the outside drive housing 98 accommodates the spindle 75 and allows drive housing to slide transversely with respect to the spindle.

Figure 2:
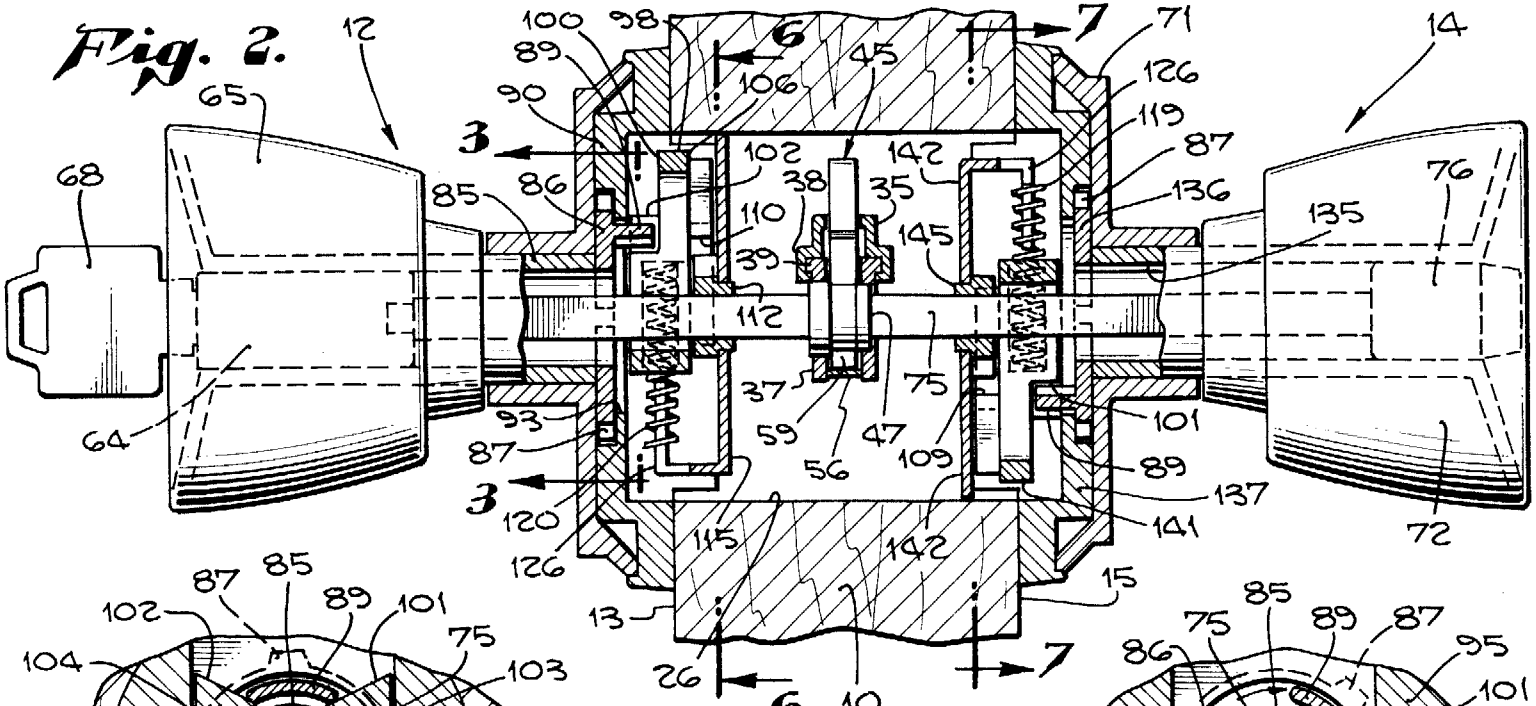
FIG. 2 is a longitudinal sectional view on the line 2—2 of FIG. 1.
Figure 4:
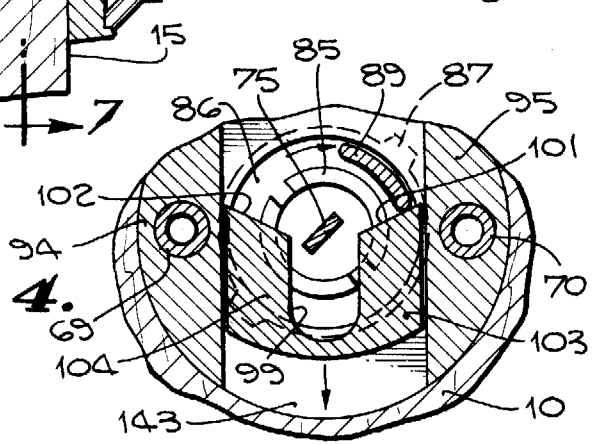
FIG. 4 is a cross-sectional view similar to FIG. 3 in a different position of operation.
Figure 3:
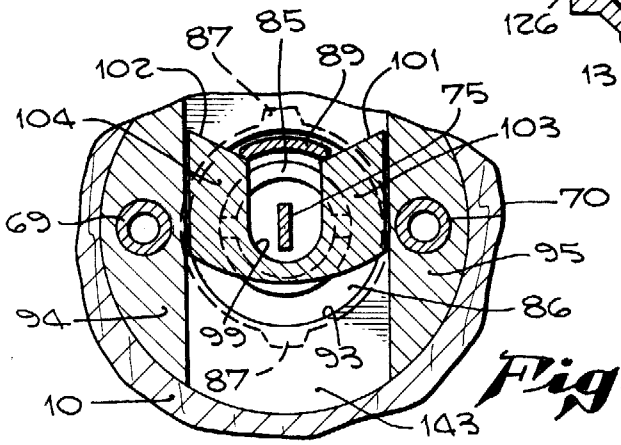
FIG. 3 is a cross-sectional view on the line 3—3 of FIG. 2.

On the outer face 100 of the outside drive housing 98 are ledges 101 and 102 serving as cam ways for engagement by one end edge or the other of the raised surface 89 of the cam and retaining washer 86. It is the action of the end edges of the raised portion on the ledges which give the outside drive housing motion in a transverse direction namely diametrically with respect to the axis of the spindle 75. Bosses 103 and 104 provide adequate thickness in order for the ledges to be formed, FIGS. 2, 3, and 4.

On the inner face 106 of the outside drive housing 98 is another pair of bosses 107 and 108, located at the opposite end of the aperture 99, which provide ledges 109 and 110, also serving as cam ways. These last mentioned ledges or cam ways are designed to cooperate with a cam finger 111 which extends radially outwardly from the hub 112. In the hub is a slot 113 for reception of the spindle 75 so that shifting the cam finger 111 causes the hub to rotate the spindle 75, thus providing an outside driving means.

Actually there is a second slot 114 angularly disposed with respect to the slot 113, likewise adapted to receive the spindle. The second slot 114 is made use of when the device is readjusted for installation on a door which opens in the opposite direction. In a sense the hub serves as a hub cam, the hub cam and cam finger serving as a driving means for the spindle, and as a consequence a driving means for the latch bolt subassembly.

For confining the outside drive housing 98 in its reciprocating position as escutcheon cover 115 is applied to the surfaces of the blocks 94 and 95 and secured thereto by appropriate pegs 116, riveted over or staking the cover in place. Holes 117 and 118 in the cover coincide with the respective holes 91 and 92 in the escutcheon housing 90 for accommodation of the posts 69 and 70 (FIG. 15).

For normally urging the outside drive housing 98 toward one end of its transverse direction of travel, namely upwardly as shown, there are provided springs 119 and 120 received in respective recesses 121 and 122 wherein they press against bottoms 123 and 124 of the recesses. Opposite ends of the springs are retained by spring keepers 125 and 126 which extend from the adjacent face of the excutcheon cover 115.

The inner trim 14 and associated parts are substantially the same as the outer trim 12 and its associated parts, except that the key actuated mechanism of the outer trim is replaced by the turn button 76 in the inner trim.

In a similar fashion an appropriate shank 135 enables the inside knob 72 to be attached rotatably on the inside rose 71 by employment of a cam and retaining washer 136 in the same manner as has been described for the outside knob and outside rose. There is also a similar inside escutcheon housing 137 with appropriate holes 138 and 139 for the posts 69 and 70 and an opening 140 for accommodation of the inside cam and retaining washer 136.

An inside drive housing 141 is identical with respect to the outside drive housing 98 except that it is reversed side for side and end for end in its position with respect to the other operating parts. An inside escutcheon cover 142 acts in the same fashion as the outside escutcheon cover 115, to hold the inside drive housing 141 in its reciprocating position within an appropriate guideway 143.

An inside cam finger 144 and its hub 145 is substantially the same as the outside cam finger 111 and its hub 112 except for one slight difference. The inside hub 145 has a single slot 146 for reception of the spindle 75 but the disposition of the slot in its angular relationship to the cam finger 144 is slightly different. This different angular relationship is relied on to enable rotation of the inside knob to be always capable of withdrawing the latch bolt, as by inside driving means.

In operation, let it be assumed that when the device is serving as a spring latch the key operated mechanism is in unlocked position, as is also the turn button 76. When this condition prevails, the compression spring 42 is acting to extend the bolt extension 35 and attached latch bolt 17 outwardly to the position of FIGS. 2 and 5. As thus extended, the latch bolt will span the gap 27 and project into the hole 19 in the strike plate 20. The distance extended is normally about one-half inch.

When thus extended, the latch bolt can be withdrawn by rotating either the outside knob 65 or the inside knob 72. If it be the outside knob which is rotated, FIGS. 2, 3, and 4, that rotation in turn will rotate the cam and retaining washer 86, in one direction or the other as the case may be. Depending on which is the direction of rotation, one end or the other of the raised surface 89 will move downwardly into engagement with the corresponding ledge 101 or 102 serving as a cam way. This will cause the outside drive housing 98 to move downwardly forcing the ledge 110, serving as a cam way into engagement with the cam finger 111 thereby to rotate the hub 112 in a clockwise direction see FIGS. 6 and 7. Movement as described will cause the spindle 75 to likewise rotate in a clockwise direction. When the spindle 75 rotates as described the main cam member 45 and its latch cam 46 will move its rearward face 51 against the cam engaging shoulder 53 of the bolt extension 35, causing it to move in a direction from left to right as viewed in FIGS. 5 and 8. As a consequence the latch bolt 17 will be withdrawn.

Figure 10:
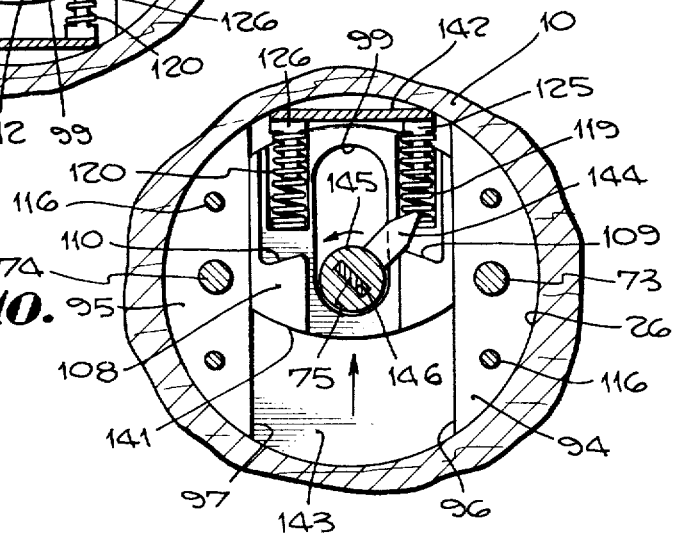
FIG. 10 is a cross-sectional view similar to FIG. 7 with parts in position for latch bolt retracted.

Should it be in the inside knob which is rotated under these circumstances it will be the cam and retaining washer which is rotated so that one end or the other of the corresponding raised surface 89 will be moved against a corresponding ledge 101, 102 of the inside drive housing 141, serving as a cam way. In this instance the drive housing is moved upwardly, the upward movement causing the ledges 109, 110 serving as cam ways to move upwardly as shown in FIG. 10. In this particular example the ledge 110 serving as a cam way moves against the cam finger 144 causing it to rotate in a counterclockwise direction as viewed in FIG. 10 together with its hub 145. The counterclockwise motion causes the spindle 75 to rotate in a counterclockwise direction, the result of which is to rotate the main cam member 45 in the same manner as previously described thereby to withdraw the latch bolt 17. Since FIGS. 6 and 10 are viewed in opposite directions the net effect on the spindle 75 is the same.

Let it now be assumed that the latch bolt is to be extended to dead bolt position, namely, in the position of FIG. 11. This can be accomplished either by action of the key 68 or the turn button 76, If the key 68 is rotated the key actuated mechanism 64 serves to rotate the spindle 75 in a counterclockwise direction as viewed in FIGS. 11 and 12. This has the effect of rotating the main cam member 45 in counterclockwise direction moving the forward face 48 against the cam engaging shoulder 50 of the bolt extension 35. The end result is shifting the latch bolt outwardly to full extended dead bolt position as shown in FIG. 11. In that position the detent notch 49 engages the cam engaging shoulder 50 so that the latch bolt is in effect locked in the outwardly extended position.

The same result is accomplished when the turn button is rotated. Such rotation also results in the counterclockwise rotation of the spindle with the same sequence of events causing extension of the latch bolt to dead bolt position. In that position the latch bolt can be withdrawn by rotation of the inside knob 72 but cannot be withdrawn by rotation of the outside knob 65. The reason for being able to withdraw the latch bolt by action of the inside knob 72 is because, whether the latch bolt is in the spring latch position of FIG. 5, partially extended, or the dead bolt position of FIG. 11, fully extended, the angular disposition of the cam finger 144 for the inside hub 145 is such that it continues to lie in the path of movement of the ledges 110. Consequently rotation of the inside knob and its cam and retaining washer 136, when acting to move the inside drive housing 141 in a transverse direction, serves to rotate the main members, in any event, and thereby withdraw the latch bolt until it clears the strike plate.

On the contrary, when the latch bolt is fully extended to dead bolt position rotation on the outside knob will not have the effect described. This is because, as viewed in FIG. 12, the cam finger 111 of the outside driving means or hub 112 has an angular disposition such that it lies within the clear way intermediate the bosses 107 and 108. In that position the cam finger 111 cannot be engaged by either of the ledges 109 or 110. Consequently even though the outside knob 65 can be rotated, causing the outside drive housing 98 to move transversely in the usual path and for the usual distance, it has no effect on the spindle and consequently no effect upon the latch bolt.

The latch bolt can however be withdrawn from dead bolt position by manipulation of the key 68. The key, acting through the key actuated mechanism (not shown) in the outside knob 65 rotates the spindle 75 directly and as a consequence the main cam member 45 is rotated so as to shift the bolt extension inwardly the necessary distance thereby withdrawing the latch bolt, against tension of the compression spring 42. Once the key is released together with the outside handle 65 the compression spring 42 will return the latch bolt to its partially extended spring latch position.

It is significant that when the latch bolt is released after having been withdrawn and is urged outwardly by the compression spring 42, the detent notch 52 will catch on the edge of the cam engaging shoulder 53 and hold the latch bolt assembly in that position namely the partially extended spring latch position, approximately a one-half inch projection. From this position retraction of the latch in any manner as by slamming the door or pushing it with the finger, with subsequent urging of the bolt outwardly by the spring 42, the latch bolt will stop at the same position thereby always projecting the bolt only as far as the spring latch position, approximately one-half inch outwardly.

The flat springs 55, 56 serve as a damper to inertia created in the main cam member 45 when the latch bolt is released suddenly thus preventing accidental override of the detent notch 52. To force the latch bolt to the fully extended dead bolt position rotation of the key 68 on one hand or rotation of the turn button 76 on the other hand can be made with sufficient force to overcome the detenting action just described.

An interesting incident to the structure and operation just described is that rotational movement of either of the knobs in either direction of rotation is translated into transverse movement of one or another of the drive housings. The transverse movement ultimately causes rotation in one direction only of the spindle 75, the main cam 45, and as a consequence linear movement of the latch bolt 17.

In a second form of the invention, particulars of which are illustrated in FIGS. 16 through 19 inclusive, the turn button 76 for the inside knob 72 is replaced with a key actuated means 150 adapted to be manipulated by a key 68'. The keys 68 and 68' are duplicates. A shank 151 for the inside knob 72 serves the same purpose as the shank 85 for the outside key actuated mechanism 64 in that it engages the inside cam and retaining washer 136. The inside knob 72 therefor operates in the same manner as the outside knob 65.

When two separate key actuated mechanisms are employed, as in the second form of the invention, the spindle then needs to be divided into two separate spindle elements 75$^a$ and 75$^b$. The spindle element 75$^a$ is in engagement with the outside key actuating means 64 and the spindle element 75$^b$ is in engagement with the inside key actuating means 150. These spindle elements are in overlapped relationship and adapted to slide endwise relative to each other, so that the lock can accommodate doors of different thicknesses. In the embodiment shown the spindle elements 75$^a$ and 75$^b$ are in overlapped relationship not only within the main cam member 45 but may also be in overlapped relationship within the hub 112' of the outside driving means and the hub 145' of the inside driving means. Because of the overlapped relationship a slot 77' in the hub 47' of the main cam 45 must have double the width to accommodate the double thickness of the two spindle elements 75$^a$ and 75$^b$. Similarly, when the spindle elements are as long as are shown with a door of substantially minimum thickness the spindle elements, overlapping in the hub 112' of the outside driving means necessitate crossed slots 113' and 114' of double their previous width. The same circumstance applies to the crossed slots 146' and 147' in the hub 145' of the inside driving means.

In the operation of the second form of the device, the key 68' is necessarily inserted in the inside key actuated means 150 to rotate the spindle extending or withdrawing the latch bolt 17 to or from the fully extended dead bolt position. In this second form of the device the inside knob 72, although made use of for withdrawing the latch bolt from the partially extended spring latch position, no longer has the panic feature of the first form of the invention which permits it also to withdraw the latch bolt from the fully extended dead bolt position.

Having described the invention, what is claimed as new in support of Letters Patent is as follows:

1. A door lock acting as a combination spring latch and dead bolt comprising a latch bolt subassembly with a cam engaging means thereon and adapted to move between a partially extended spring latch position, a dead bolt position, and a withdrawn position, latch bolt actuating means comprising a spindle means and a main cam member on said spindle means having an operating engagement with said cam engaging means, a key actuated outside knob member in operating engagement with said spindle means, an inside knob member having a turn member thereon in operating engagement with said spindle means, outside driving means adapted to engage said spindle means for driving said spindle means in a rotating direction, an outside drive housing having a transversely reciprocating path of movement and adapted to engage said outside driving means, and a cam drive between said outside knob member and said outside drive housing, an inside driving means adapted to engage said spindle means for driving said spindle means in a rotating direction, an inside drive housing having a transversely reciprocating path of movement and adapted to engage said inside drive means, and a cam drive between said inside knob member and said inside drive housing, a clear way between said outside drive housing and said outside drive means when said latch bolt subassembly is in dead bolt position whereby the outside knob member is free of operating engagement with said spindle means when the latch bolt subassembly is in dead bolt position.

2. A door lock as in claim 1 wherein said inside knob assembly and said inside driving means are in constant potential engagement whereby said latch bolt subassembly is at all times subject to operation by said inside knob member, the driving means of both said drive housings being in potential operative engagement with said spindle means when said latch bolt subassembly is in extended spring latch position.

3. A door lock as in claim 2 wherein said outside and inside drive housing each has a cam way thereon, said drive means each comprising a spindle engaging hub with a driver on said hub, said driver having a driven engagement with the cam way on the respective drive housing whereby rotation of said spindle means is the result of transverse movement of said drive housing.

4. A door lock as in claim 3 wherein said cam member comprises two oppositely facing cam elements at circumferentially spaced locations.

5. A door lock as in claim 2 wherein the cam drive between each knob member and the respective drive housing comprises a rotating cam member having the same axis of rotation as said knob member and in operating engagement with said knob member.

6. A door lock as in claim 2 wherein said drive housings each have an elongated transversely extending slot through which the spindle means extends, a cam way on one side of the drive housing for operating engagement with the respective driving means and a cam way on the other side for operating engagment with the corresponding knob.

7. A door lock as in claim 6 wherein there is an escutcheon housing in association with each knob, each excutcheon housing having a transversely extending guide way, the corresponding drive housing being reciprocatively mounted in the guide way.

8. A door lock as in claim 7 wherein the clear way between said outside drive housing and said outside driving means is in alignment with the corresponding guide way, there being a section of the cam way on one side of the clear way, said outside driving means having an angular disposition on the spindle means wherein when the latch bolt subassembly is in dead bolt position, a driver on the outside driving means resides in said clear way free of engagement with said corresponding cam way and when the latch bolt subassembly is in partially extended spring latch position said driver for the outside driving means is in a position of potential engagment with the corresponding cam way.

9. A door lock as in claim 7 wherein said outside driving means and said inside driving means each comprise a hub in non-rotating engagement with the spindle means and with the driver being a finger extending radially outwardly from said hub, said fingers being at different angular dispositions relative to each other such that when the finger of the outside driving means is within said clear way the finger of said inside driving means is in a position for engagement with the corresponding cam way of the inside drive housing.

10. A door lock as in claim 7 wherein the clear way between said inside drive housing and said inside driving means is in alignment with the corresponding guide way, there being a section of the cam way on one side of the clear way, said inside driving means having an angular disposition on the spindle means wherein when the latch bolt subassembly is in dead bolt position, a driver on the inside driving means resides in said clear way free of engagement with said corresponding cam way and when the latch bolt subassembly is in partially extended spring latch position said driver for the inside driving means is in a position of potential engagement with the corresponding cam way.

11. A door lock as in claim 1 wherein said cam engaging means comprises transversely extending shoulder means on said latch bolt subassembly.

12. A door lock as in claim 1 wherein said main claim member comprises an arm in non-rotatable engagement with the spindle means and detent elements on the arm having respective different positions of engagement with said cam engaging means.

13. A door lock as in claim 12 wherein there is a spring means acting against the main cam member whereby to releasably detain said arm in respective different positions of engagement with the latch bolt subassembly.

14. A door lock as in claim 1 wherein there is a detent obstruction on one side of the main cam member having a dead locking engagement with the latch bolt subassembly in said dead bolt position.

15. A door lock as in claim 1 wherein there is a detent obstruction on one side of the main cam member having a detent engagement with said cam engaging means when the latch bolt subassembly is in spring latch position.

16. A door lock as in claim 1 wherein said turn member on the inside knob is a key actuated member and said spindle means is in engagement with said key actuated member.

17. A door lock as in claim 16 wherein said spindle means comprises two separate spindle elements in overlapping relationship with each other, one of said spindle elements being in engagement with the key actuated outside knob member and the other spindle element being in engagement with the inside key actuated member.

18. A door lock as in claim 17 wherein said spindle elements are longitudinally slidable relating to each other and are in overlapping relationship within said main cam member.

* * * * *